US008109607B2

(12) United States Patent
Chen et al.

(10) Patent No.: US 8,109,607 B2
(45) Date of Patent: Feb. 7, 2012

(54) FLUID EJECTOR STRUCTURE AND FABRICATION METHOD

(75) Inventors: Chien-Hua Chen, Corvallis, OR (US); Martha A Truninger, Corvallis, OR (US); Michael Monroe, Philomath, OR (US); Steven R Geissler, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 658 days.

(21) Appl. No.: 12/205,709

(22) Filed: Sep. 5, 2008

(65) Prior Publication Data

US 2009/0225131 A1 Sep. 10, 2009

Related U.S. Application Data

(60) Provisional application No. 61/035,223, filed on Mar. 10, 2008.

(51) Int. Cl.
*B41J 2/135* (2006.01)

(52) U.S. Cl. ..... 347/44

(58) Field of Classification Search ..... 347/20, 347/44, 45, 47

See application file for complete search history.

(56) References Cited

U.S. PATENT DOCUMENTS 7,255,425 B2 8/2007 Lai et al.

*Primary Examiner* — An Do

(57) ABSTRACT

In one embodiment, a fluid ejector structure includes an orifice sub-structure and an ejector element sub-structure direct contact bonded together along a direct contact bonding interface. The orifice sub-structure has a plurality of orifices therein. Each orifice is positioned adjacent to a corresponding one of a plurality of fluid ejection elements on the ejector element sub-structure.

7 Claims, 18 Drawing Sheets

FLUID EJECTOR STRUCTURE AND FABRICATION METHOD

CROSS-REFERENCE TO RELATED APPLICATIONS

This Application claims the benefit of U.S. Provisional patent application Ser. No. 61/035,223, filed Mar. 10, 2008, which is hereby incorporated by reference in it's entirety.

BACKGROUND

Thermal inkjet printers typically utilize a printhead that includes an array of orifices (also called nozzles) through which ink is ejected on to paper or other print media. One or more printheads may be mounted on a movable carriage that traverses back and forth across the width of the paper feeding through the printer, or the printhead(s) may remain stationary during printing operations, as in a page width array of printheads. A printhead may be an integral part of an ink cartridge or part of a discrete assembly to which ink is supplied from a separate, often detachable ink container. Ink filled channels feed ink to a firing chamber at each orifice from a reservoir ink source. Applied individually to addressable thermal elements, such as resistors, ink within a firing chamber is heated, causing the ink to bubble and thus expel ink from the chamber out through the orifice. As ink is expelled, the bubble collapses and more ink fills the chamber through the channels from the reservoir, allowing for repetition of the ink expulsion sequence.

Many conventional thermal inkjet printheads are currently produced with ink feed channels formed in a semiconductor substrate structure that includes the firing resistors. A barrier layer is formed on the substrate structure and a metal or polyimide (e.g., Kapton®) orifice plate is attached to the barrier layer. The ink feed channels carry ink to openings in the barrier layer that direct ink to the resistors and partially define the firing chamber volume for each resistor. The barrier layer material is usually a thick, organic photosensitive material laminated onto the substrate structure, and then patterned and etched with the desired opening and chamber configuration. The orifice plate provides the ink ejection/expulsion path for the firing chambers. Metal and polyimide orifice plate materials and organic barrier layer materials, however, can be susceptible to corrosion from printing inks, thus potentially limiting the ink chemistry options for better printing performance Also, during printhead fabrication, aligning and attaching the orifice plate to the barrier layer on the substrate structure requires special precision and special adhesives. If the orifice plate is warped or dimpled, or if the adhesive does not correctly bond the orifice plate to the barrier layer, poor control of the ink drop trajectory may result. Often, individual orifice plates must be attached at single printhead die locations on a semiconductor substrate wafer/structure that contains many such die locations. It is desirable, of course, for increasing productivity as well as helping ensure proper orifice plate alignment to have a fabrication process that allows for placement of a single orifice plate over the entire substrate structure to cover all of the printhead die locations. Some efforts to fabricate orifice plates from a deposited dielectric material have met with only limited success due to high dielectric deposition temperatures and large built-in stresses for thick dielectric layers.

DRAWINGS

The structures shown in the figures, which are not to scale, are presented in an illustrative manner to help show pertinent structural and processing features of the disclosure

DESCRIPTION

Embodiments of the present disclosure were developed in an effort to improve methods for fabricating thermal inkjet printhead structures and to improve the printhead structures themselves. Embodiments of the disclosure, therefore, will be described with reference to the fabrication of a thermal inkjet printhead structure. Embodiments, however, are not limited to thermal inkjet printhead structures, or even inkjet printhead structures in general, but may include other fluid ejector structures and fabrication methods for such ejector structures. Hence, the following description should not be construed to limit the scope of the disclosure.

Figure 1:
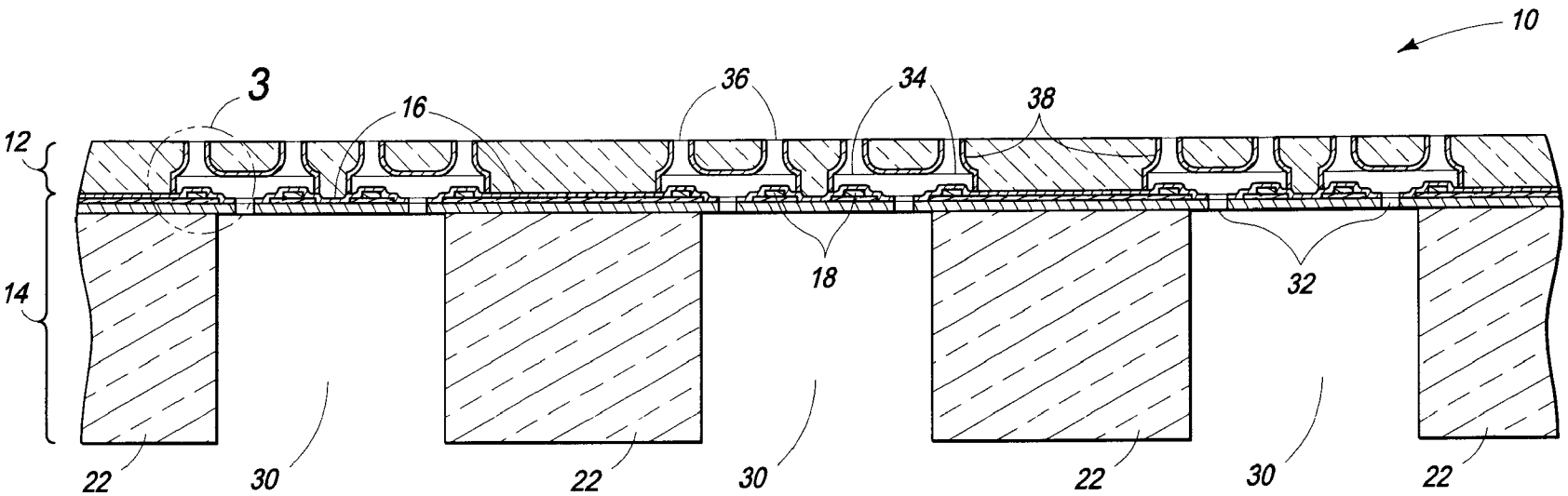
FIGS. 1 and 2 are elevation and perspective section views, respectively, illustrating a thermal inkjet printhead structure according to one embodiment of the disclosure.
Figure 3:
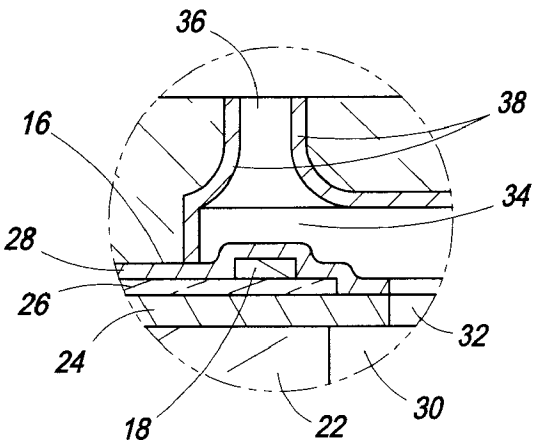
FIG. 3 is a detail section view of a portion of the printhead structure shown in FIG. 1.
Figure 2:
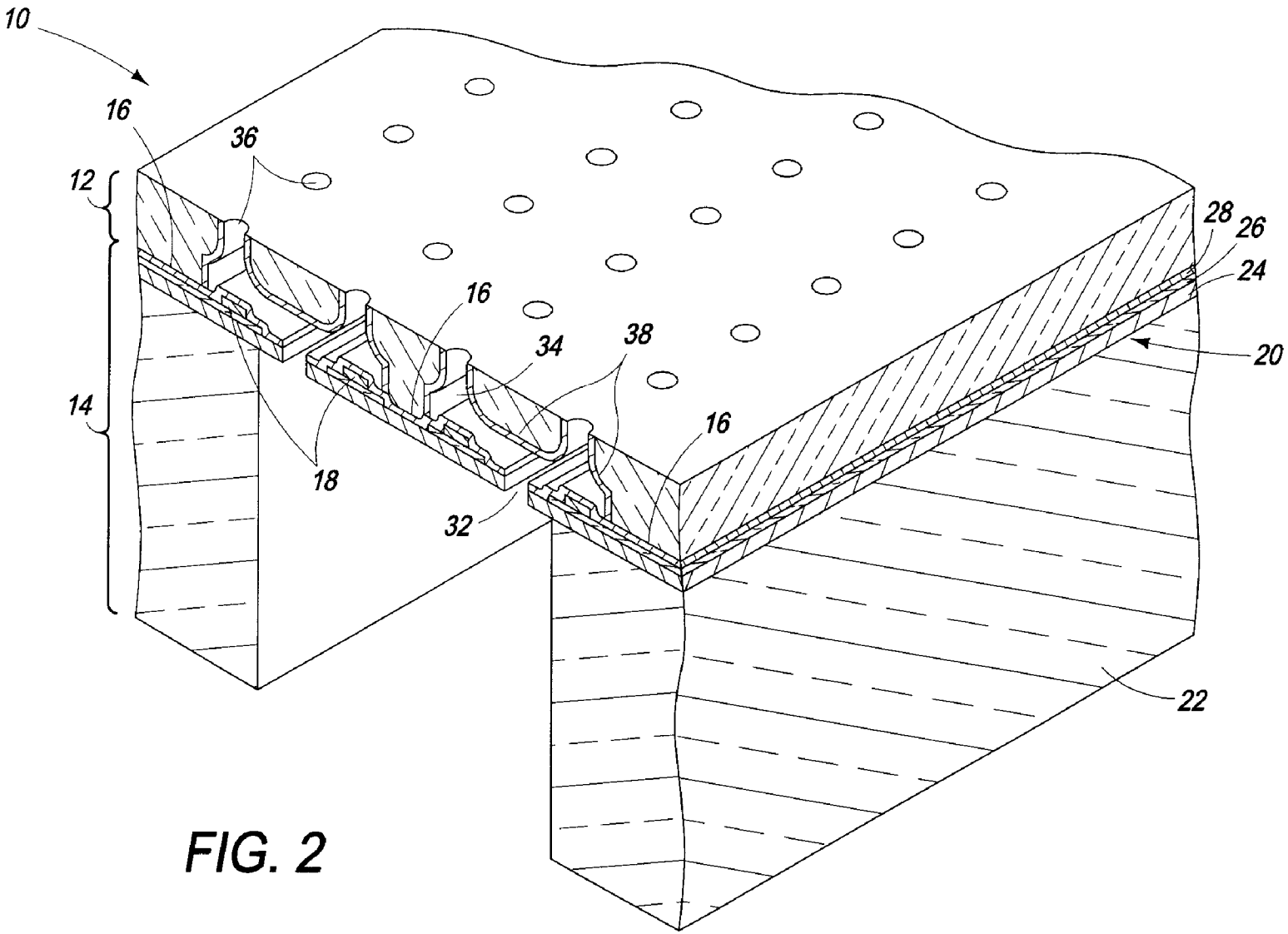

FIGS. 1 and 2 are elevation and perspective section views, respectively, illustrating a thermal inkjet printhead structure 10 according to one embodiment of the disclosure. Inkjet printhead structure 10 represents more generally a fluid-jet precision dispensing device or fluid ejector structure for precisely dispensing a fluid, such as ink, as described in more detail below. FIG. 3 is a detail section view of a portion of printhead structure 10 within the circle shown in FIG. 1. Referring to FIGS. 1-3, printhead structure 10 is formed as a composite structure that includes an orifice sub-structure 12 and an ejector element sub-structure 14 bonded together along a bonding interface 16. As described in more detail below, a direct contact bond is formed between the two sub-structures 12 and 14 at bonding interface 16 using, for example, low temperature plasma activated bonding techniques. Direct contact bonding occurs when two smooth surfaces are brought into direct contact with one another under conditions that allow bonding between the two surfaces at near room temperature. Plasma activation increases the density of the chemical interface species so a robust covalent bond may be achieved at low temperature. Annealing the plasma activated bond increases bond strength.

While this Description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector structure for dispensing a substantially liquid fluid. A fluid-jet precision dispensing device is a drop-on-demand device in which printing, or dispensing, of the substantially liquid fluid in question is achieved by precisely printing or dispensing in accurately specified locations, with or without making a particular image on that which is being printed or dispensed on. As such, a fluid-jet precision dispensing device is in comparison to a continuous precision dispensing device, in which a substantially liquid fluid is continuously dispensed therefrom. An example of a continuous precision dispensing device is a continuous inkjet printing device.

The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the following description is described in relation to an inkjet printhead structure for ejecting ink onto media, embodiments of the present disclosure more generally pertain to any type of fluid-jet precision dispensing device or fluid ejector structure for dispensing a substantially liquid fluid as has been described in this paragraph and the preceding paragraph.

Firing resistors 18 in ejector element sub-structure 14 are formed as part of a thin film stack 20 on a substrate 22. Although a silicon substrate 22 is typical, other suitable substrate materials could be used. In addition to firing resistors 18, thin-film stack 20 usually also will include layers/films that electrically insulate resistors 18 from surrounding structures, provide conductive paths to resistors 18, and help protect against contamination, corrosion and wear (such protection is often referred to passivation). In the embodiment shown, as best seen in FIG. 3, film stack 20 includes a field oxide layer 24 on substrate 22, a glass layer 26 (typically phosphosilicate glass (PSG)) on field oxide 24, and a passivation dielectric layer 28 over resistors 18 and glass layer 26. The specific configuration of film stack 20 is not important to the innovative aspects of this disclosure except that the exposed surface of film stack 20 along direct contact bonding interface 16 must be suitable for bonding to a mating surface on orifice sub-structure 12. Suitable direct contact bond interface materials are discussed below with regard to the fabrication method illustrated in FIGS. 4-8.

Channels 30 in substrate 22 carry ink to ink feed slots 32 that extend through film stack 20 near resistors 18. Ink enters a firing chamber 34 associated with each firing resistor 18 through a corresponding feed slot 32. Ink drops are expelled or "fired" from each chamber 34 through an orifice 36 in orifice sub-structure 12. Orifice sub-structure 12 may include a dielectric or other suitable passivation layer 38 along those areas exposed to ink, for example at firing chambers 34 and orifices 36.

FIGS. 4-8 are elevation section views illustrating one embodiment of a method for fabricating printhead structure 10 shown in FIGS. 1 and 2. The individual processing techniques that may be used to carry out the methodology described below are conventional techniques well known to those skilled in the art of printhead fabrication and semiconductor processing. Thus, the details of those techniques are not included in the description. For example, semiconductor wafer processing in general, including printhead fabrication, sometimes includes photolithographic masking and etching. This process consists of creating a photolithographic mask containing the pattern of the component to be formed, coating the structure with a light-sensitive material called photoresist, exposing the photoresist coated structure to ultra-violet light through the mask to soften or harden parts of the photoresist, depending on whether positive or negative photoresist is used, removing the softened parts of the photoresist, etching to remove the materials left unprotected by the photoresist, and stripping the remaining photoresist. This photolithographic masking and etching process is referred to herein as "masking and etching." Other patterning techniques may also be used in the selective removal of materials, thus the process may be referred to more generally as "patterning and etching." Although it is expected that the selective removal of materials will often involve patterning and etching, other selective removal processes could be used. Hence, references to patterning and etching should not be construed to limit the processes that may be used for the selective removal of material.

Figure 4:
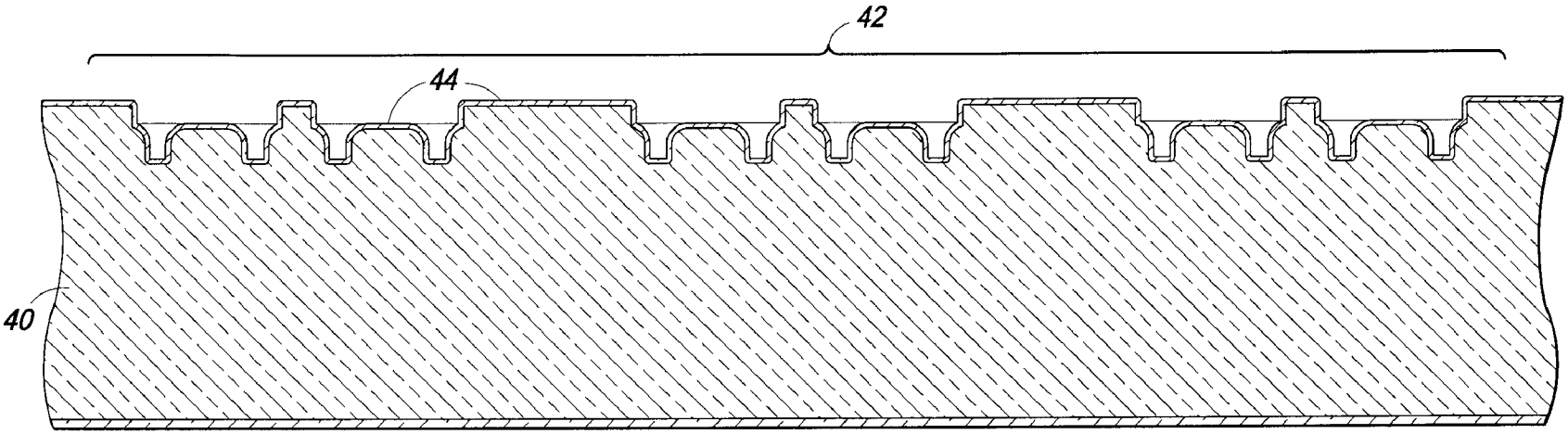
FIGS. 4-8 are elevation section views illustrating one embodiment of a method for fabricating a thermal inkjet printhead structure such as the one shown in FIGS. 1 and 2.

Referring first to FIG. 4, an orifice substrate 40 is patterned and etched along an orifice area 42 to form the desired configuration for the firing chambers 34, orifices 36 and bonding interface 16 shown in FIGS. 1 and 2. Depending on the material used for substrate 40, it may be necessary or desirable to form a passivation layer 44 on substrate 40 along orifice area 42 to inhibit corrosion from prolonged exposure to ink. For a silicon substrate 40, for example, passivation layer 44 may be formed by oxidizing the exposed outer surfaces of substrate 40.

Figure 5:
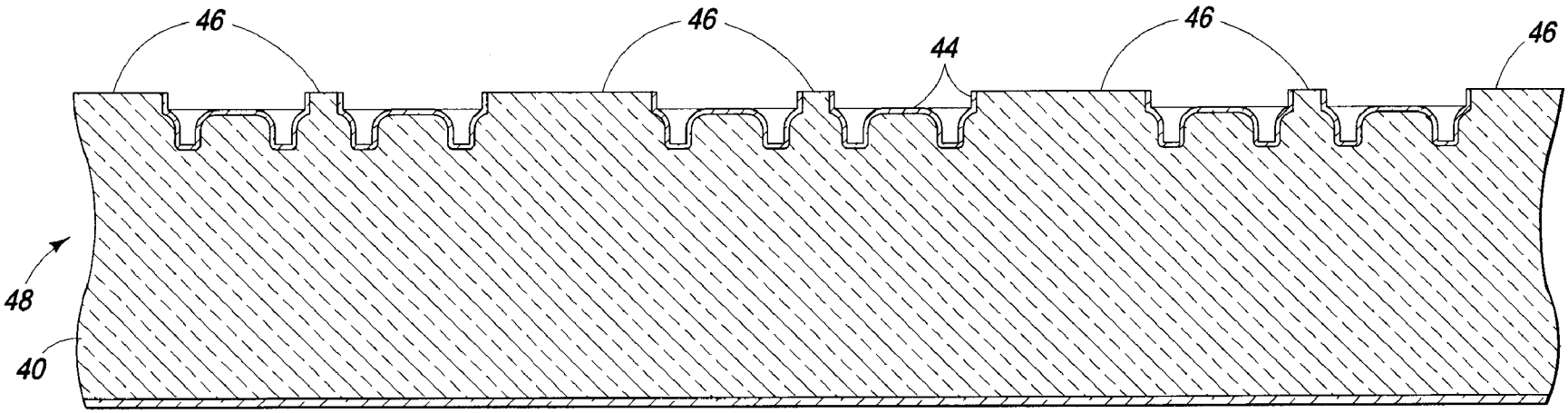

Referring to FIG. 5, oxide passivation layer 44 is selectively removed to expose silicon substrate 40 and form direct contact bond surfaces 46 using, for example, a buffered oxide etch such as a buffered hydrogen fluoride (HF) etch. The in-process orifice sub-structure shown in FIG. 4 is designated by part number 48. Suitable direct contact bond interfaces include oxide to oxide, oxide to silicon, and silicon to silicon. The surface energy of an oxide to silicon bond interface can be nearly twice that of an oxide to oxide bond interface. Thus, oxide bond surfaces on ejector element sub-structure 14 and silicon bond surfaces 46 on orifice sub-structure 12 are expected to yield higher bond strength and, therefore, may be desirable in printhead fabrication. TEOS and other suitable dielectric materials, however, may also be used for orifice substrate bond surfaces 46. (TEOS refers to the deposition of silicon dioxide using a tetraethylorthosilicate low temperature chemical vapor deposition (TEOS) process.)

Figure 6:
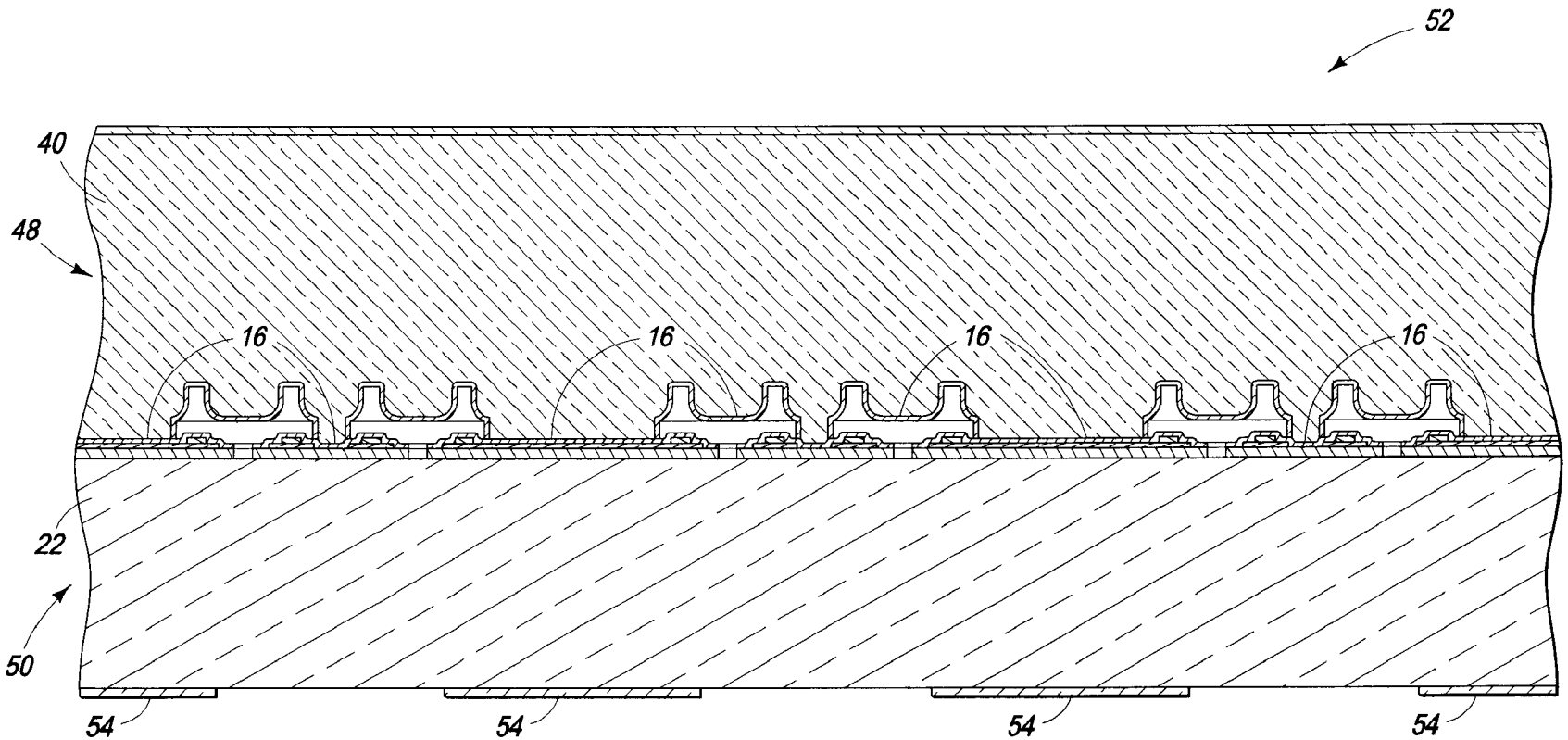

Referring to FIG. 6, in-process orifice sub-structure 48 and an in-process ejector element sub-structure 50 are aligned with one another and direct contact bonded together to form an in-process composite printhead structure 52. In the embodiment shown, in-process ejector element sub-structure 50 has been processed through the formation of ink slots 32 in thin film stack 20, but ink channels 30 have not yet been formed in substrate 22. Also, orifice substrate 40 has not yet been thinned to open orifices 36. Although these processes might possibly be completed before direct contact bonding, it is preferred to form ink channels 30 and open orifices 36 after bonding to preserve the structural integrity of substrates 22 and 40 during bonding. Processing the comparatively thick, more robust, substrates 22 and 40 shown in FIG. 6 reduces the risk of damage during alignment and bonding operations.

A TEOS passivation layer 28 in film stack 20, best seen in FIGS. 2 and 3, will provide the desired oxide to silicon direct contact bond interface. Also, it is expected that a TEOS passivation layer 28 will provide suitable passivation characteristics for most inkjet printhead applications. A silicon nitride, silicon carbide or other suitable dielectric material, however, may be used for passivation layer 28 depending on the desired direct contact bonding interface and/or passivation characteristics for layer 28. One or both of direct contact bond surfaces 46 on in-process sub-structure 48 and passivation layer 28 on in-process sub-structure 50 (at locations of bonding interface 16) may be planarized, using CMP (chemical mechanical polishing) for example, if necessary or desirable to provide flat, smooth bonding surfaces. A direct contact bond is formed between in-process sub-structures 48 and 50 at bonding interface 16 by, for example, low temperature plasma activated bonding, which is sometimes also referred to as plasma enhanced bonding.

The use of low temperature plasmas of various ionized gases to enhance the bonding properties of bond surfaces for direct contact bonding is well known in the art of semiconductor processing. Plasma activated bonding typically involves placing the parts to be bonded into a plasma chamber, introducing a gas or mixture of gases into the chamber, and energizing the gas to produce a plasma by exposing the gas to radio frequency electromagnetic radiation. The bond surfaces are held in close proximity to one another as they are exposed to the plasma and then pressed together to bond. The bonded parts may be annealed as necessary or desirable to strengthen the bond. Although a variety of different gases may be used depending on the characteristics of the bond surfaces, it is expected that nitrogen ($N_2$) and oxygen ($O_2$) gases will induce suitable bonding between a silicon bond surface 46 on orifice sub-structure 48 and an oxide surface (passivation layer 28) on printhead sub-structure 52. In one example, exposing the bond surfaces 46 and 28 to an $N_2$ plasma at 100 watts RF power for 30 seconds will induce the activation needed to form an adequate bond. The parts are then heated to about 250° C. for approximately one hour to anneal the bond area and improve bond strength. Annealing at this temperature is significant below a typical CMOS thermal budget of 425° C. but it is sufficiently high for direct, covalent bonding two planarized dielectric surfaces.

Figure 7:
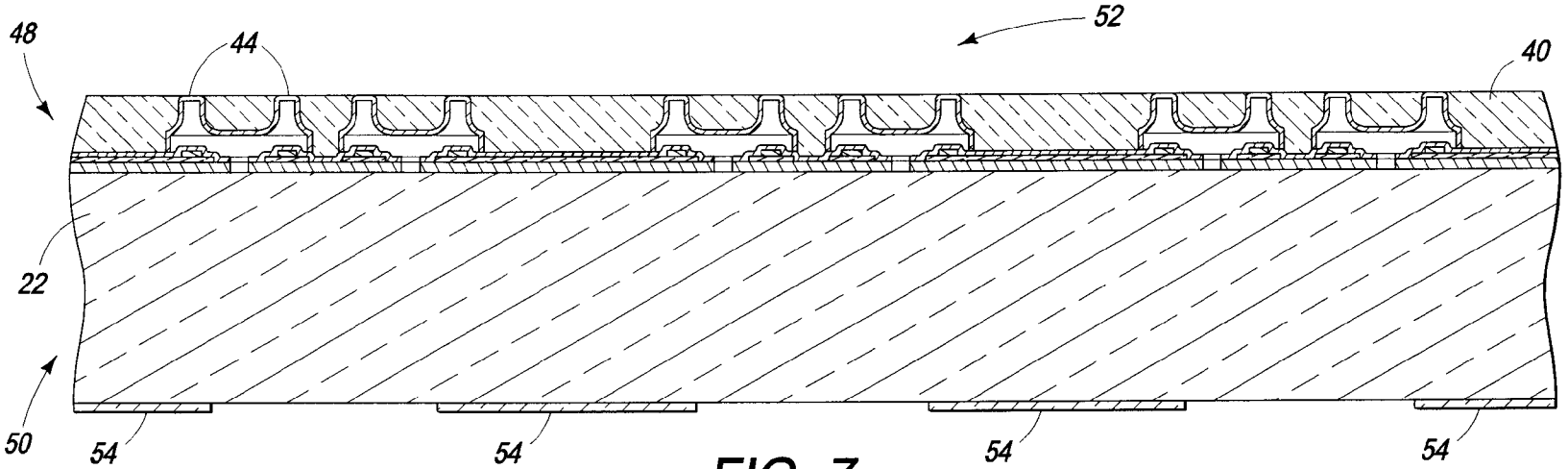
Figure 8:
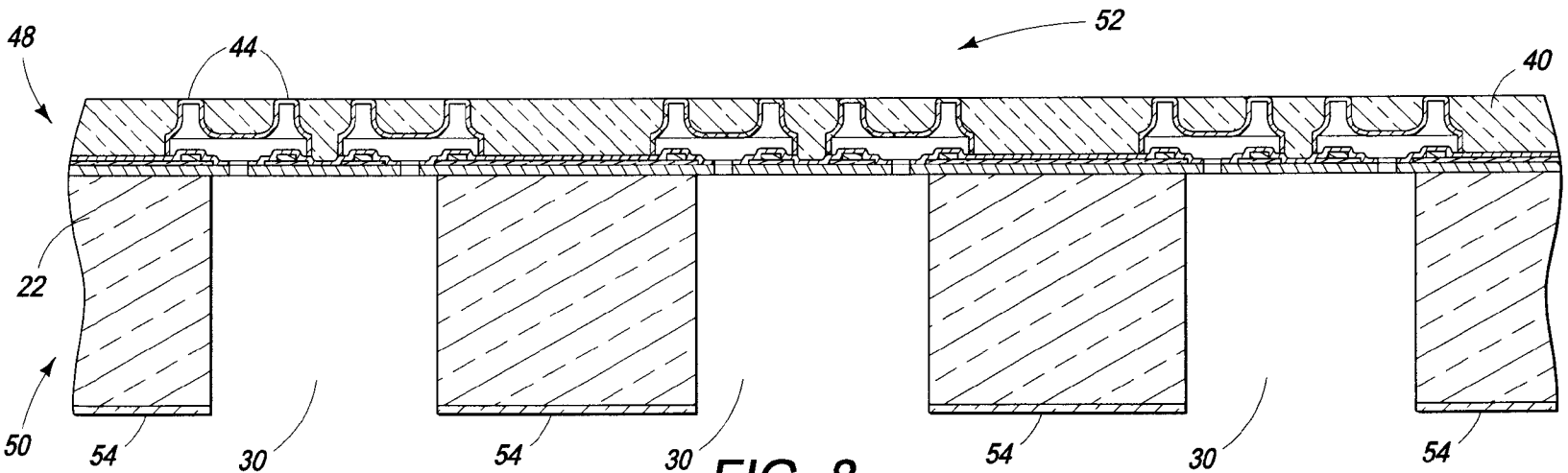

Referring now to FIG. 7, orifice substrate 40 is removed to the level of passivation layer 44 at the orifice locations by, for example, back grinding the silicon substrate 40 until reaching the oxide passivation layer 44. Although an additional cleaning step may be necessary or desirable in some circumstances following back grinding to remove any waste particles, it is expected that the deionized (DI) water rinse will usually be sufficient. Referring to FIG. 8, ejector sub-structure substrate 22 is patterned and etched to form ink channels 30 with, for example, a laser or dry reactive ion etch. In the embodiment of in-process ejector sub-structure 50 shown in FIGS. 6-8, substrate 22 is patterned for the ink channel etch with an oxide layer 54 formed on the backside of substrate 22 prior to direct contact bonding. In other embodiments, it may be desirable to pattern substrate 22 for the channel etch after bonding with, for example, photolithographic masking. As best seen by comparing FIGS. 1 and 8, passivation layer 44 is then removed at each orifice location to open orifices 36 by, for example, planarizing the top surface of orifice substrate 30 to the thickness of layer 44 (using CMP for example) or by etching away the exposed oxide passivation layer 44, but not allowing the etch to continue into the firing chambers 34, leaving a passivation layer 38 in those areas exposed to ink as shown in FIGS. 1 and 2.

The inorganic covalent bonds bonding together the ejector and orifice sub-structures of printhead structure 10 eliminate the problematic organic barrier and adhesive layers in conventional printheads that are susceptible to ink attack, thus providing a firing chamber solution with wide ink latitude that is largely inert to even aggressive solvents. The direct bonding fabrication method described above enables the low-temperature/low-stress wafer level attachment of a pre-fabricated dielectric orifice sub-structure and a nearly fully processed thermal ejector element sub-structure.

Figure 9:
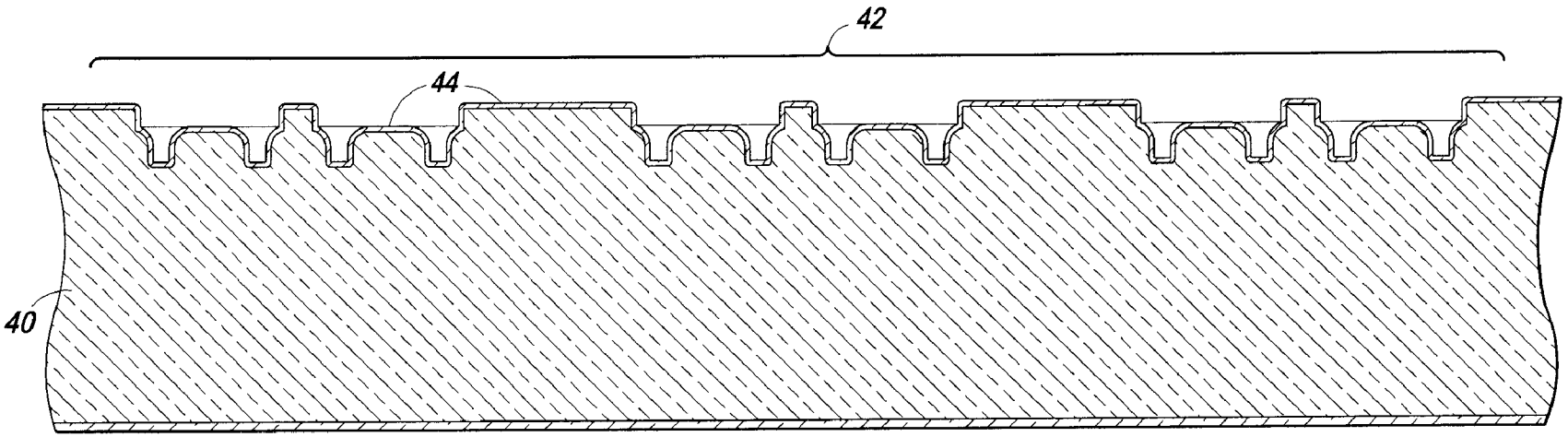
FIGS. 9-11 are elevation section views illustrating another embodiment of a method that may be used for fabricating a thermal inkjet printhead structure similar to the one shown in FIGS. 1 and 2.
Figure 10:
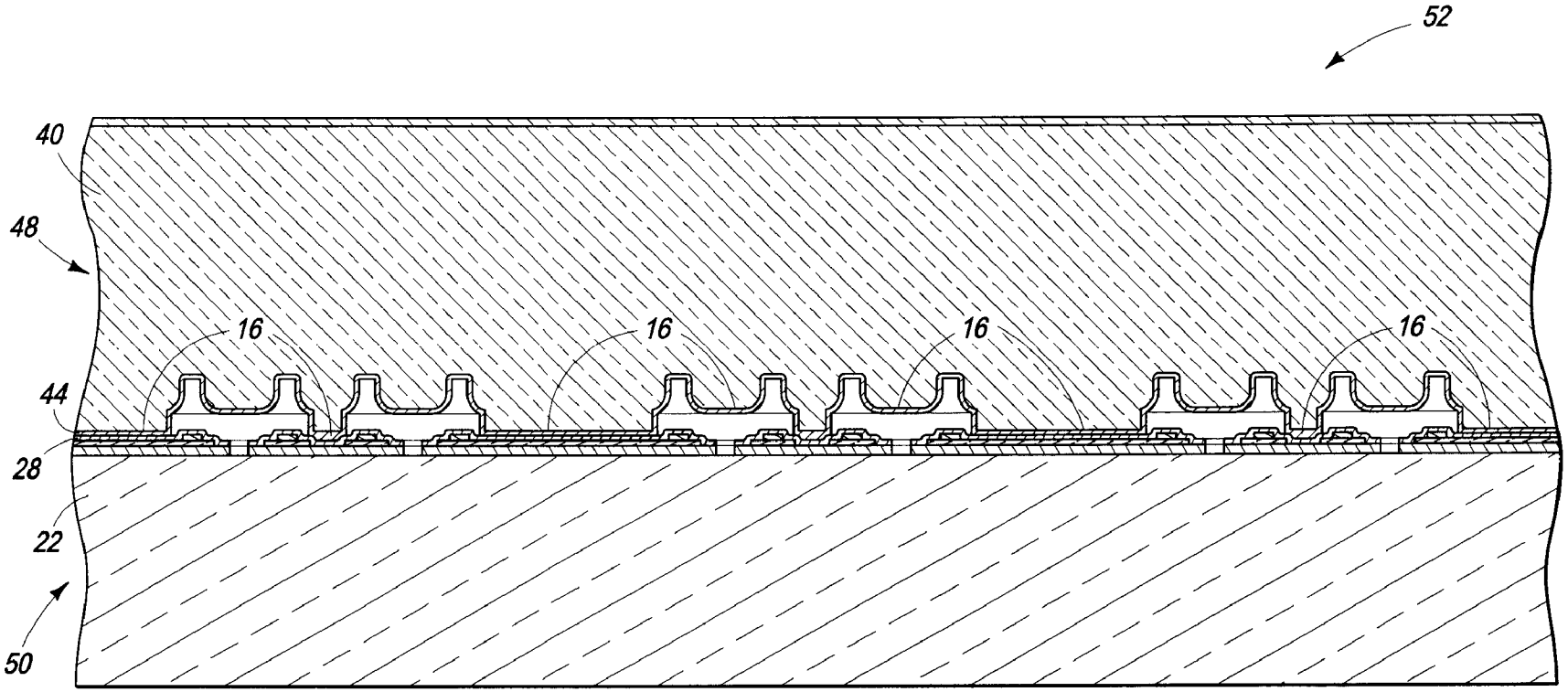
Figure 11:
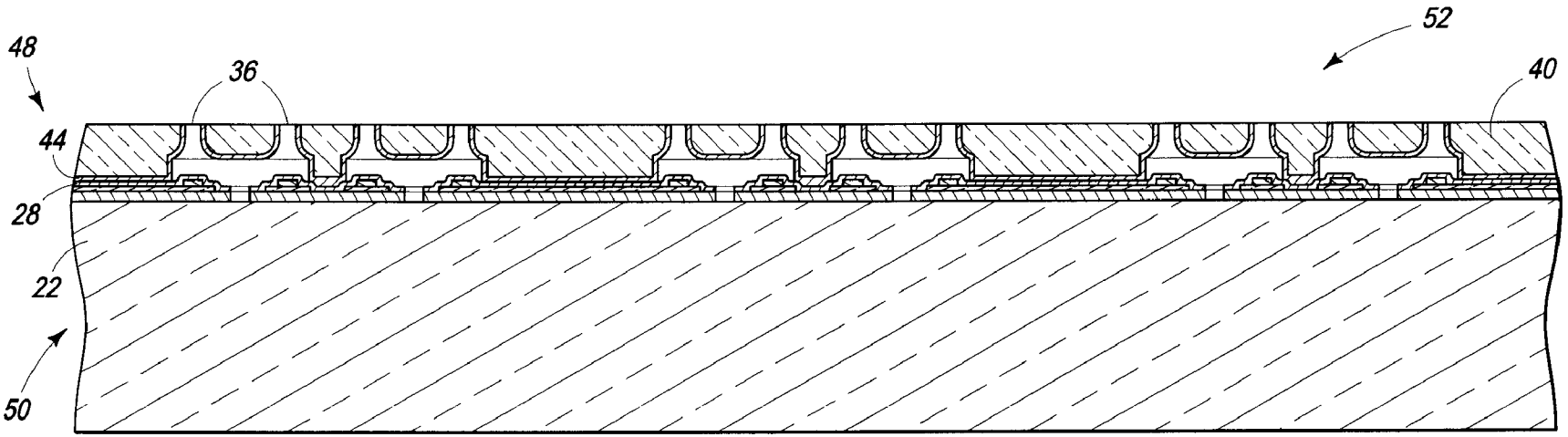

In another embodiment illustrated in FIGS. 9-11, the direct contact bond is made between an oxide layer 44 on orifice sub-structure 12 and a TEOS layer 28 on ejector element sub-structure 14. Referring to FIG. 9, a silicon orifice substrate 40 is patterned and etched along an orifice area 42 to form the desired configuration for the firing chambers 34, orifices 36 and bonding interface 16, and the silicon substrate 40 is oxided to form an oxide passivation layer 44. Referring to FIG. 10, in-process orifice sub-structure 48 and an in-process ejector element sub-structure 50 are aligned with one another and direct contact bonded together to form an in-process composite printhead structure 52. In this embodiment, oxide layer 44 is not removed from direct contact bonding surfaces 46 on orifice substrate 40 and, consequently, an oxide-to-oxide bond is formed rather than a silicon-to-oxide bond as in the first embodiment. Referring to FIG. 11, orifice substrate 40 is thinned to open orifices 36 using, for example, a grinding operation.

Figure 12:
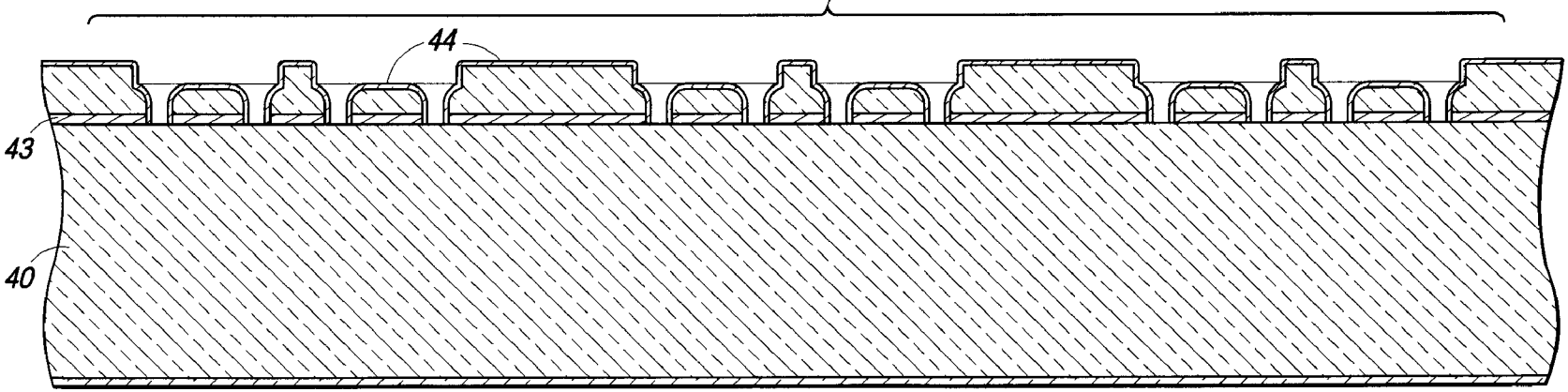
FIGS. 12-15 are elevation section views illustrating another embodiment of a method that may be used for fabricating a thermal inkjet printhead structure similar to the one shown in FIGS. 1 and 2.
Figure 13:
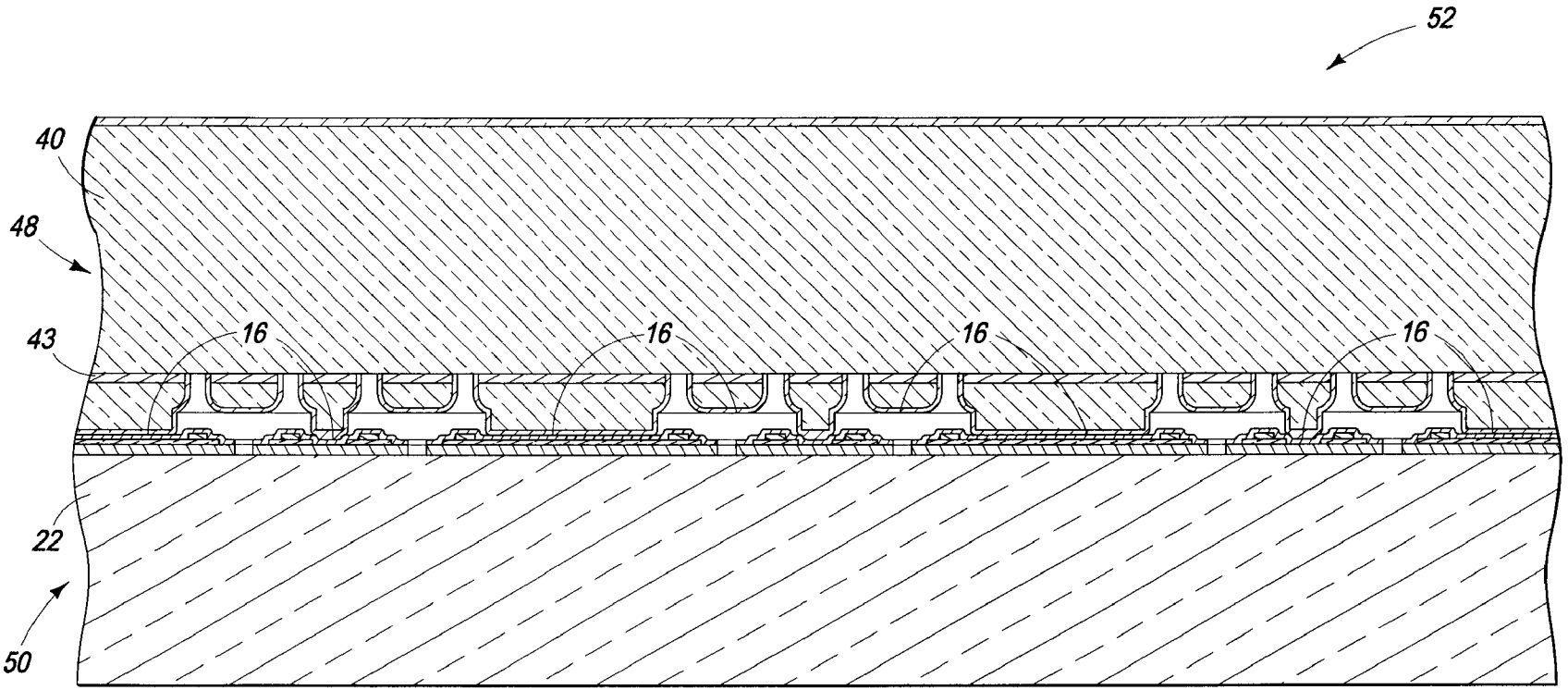
Figure 14:
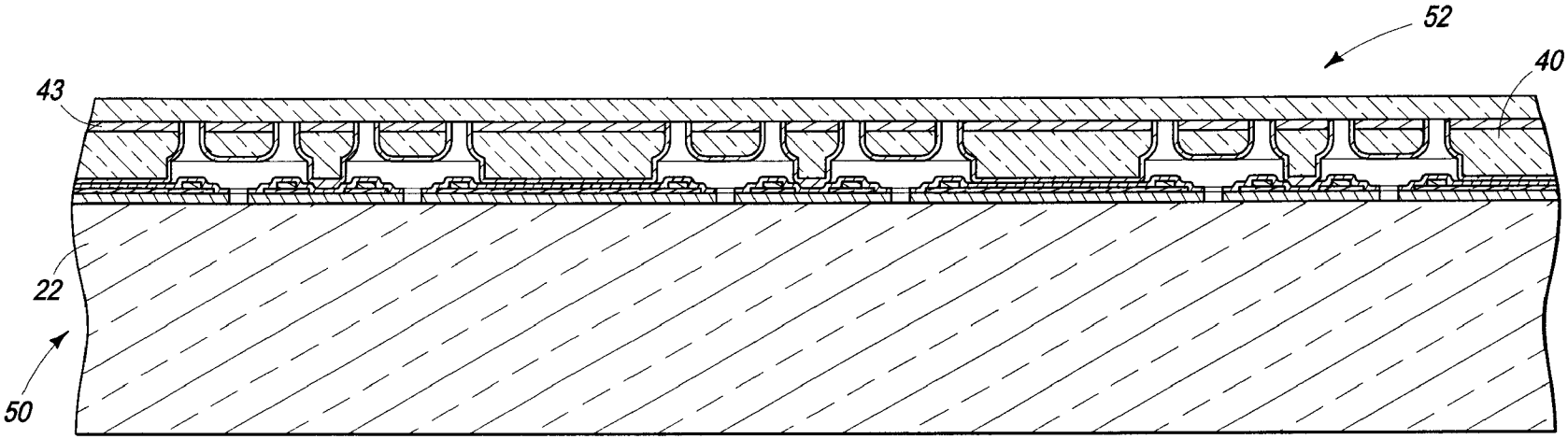
Figure 15:
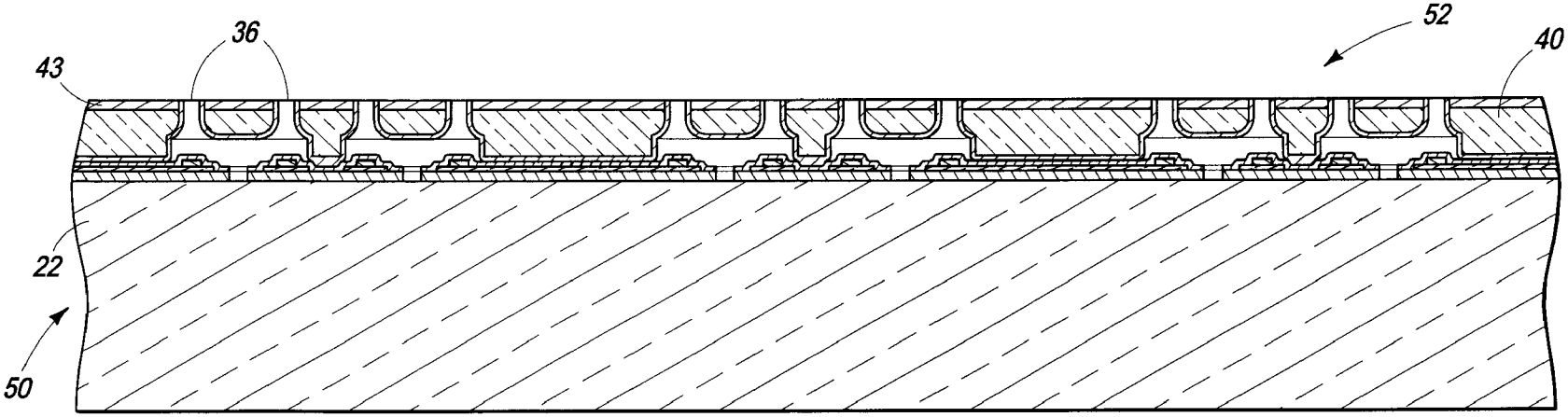

In another embodiment illustrated in FIGS. 12-15, a silicon-on-insulator (SOI) wafer is used in the fabrication of orifice sub-structure 12 (FIGS. 1 and 2). Referring to FIG. 12, an SOI substrate 40 is patterned and etched along an orifice area 42 to form the desired configuration for the firing chambers 34, orifices 36 and direct contact bonding interface 16. This topography etch may stop on the buried oxide layer 43, or it may continue through oxide layer 43 as shown in FIG. 12. Substrate 40 may then be oxidized to form an oxide passivation layer 44. Oxide layer 44 may be removed at bonding surfaces 46 as in the first embodiment described above or left in place as in the second embodiment described above. Oxide layer 44 is shown as being left in place at bonding surfaces 46 in FIG. 13. Referring to FIG. 13, in-process orifice sub-structure 48 and an in-process ejector element sub-structure 50 are aligned with one another and direct contact bonded together to form an in-process composite printhead structure 52. Referring to FIG. 14, orifice substrate 40 is ground or otherwise thinned from the back side to near buried oxide layer 43, a thickness of about 10 μm at the locations for the orifices, for example. Then, with oxide layer 43 as an etch stop, a silicon dry etch, for example, may be used to open orifices 36 as shown in FIG. 15. As an alternative, orifice substrate 40 may be ground or otherwise thinned from the back side to stop on buried oxide layer 43 and open orifices 36.

Figure 16:
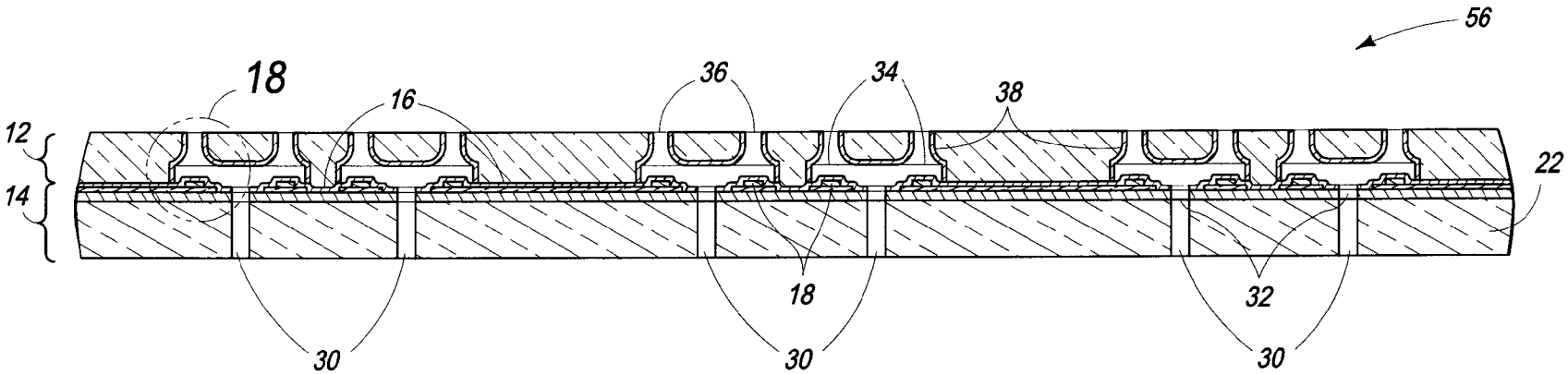
FIGS. 16 and 17 are elevation and perspective section views, respectively, illustrating a thermal inkjet printhead structure according to another embodiment of the disclosure.
Figure 18:
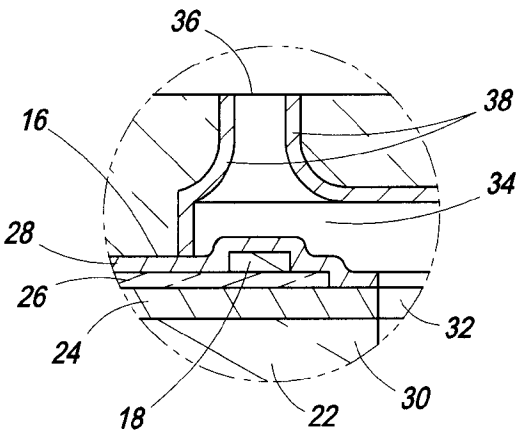
FIG. 18 is a detail section view of a portion of the printhead structure shown in FIG. 16.
Figure 17:
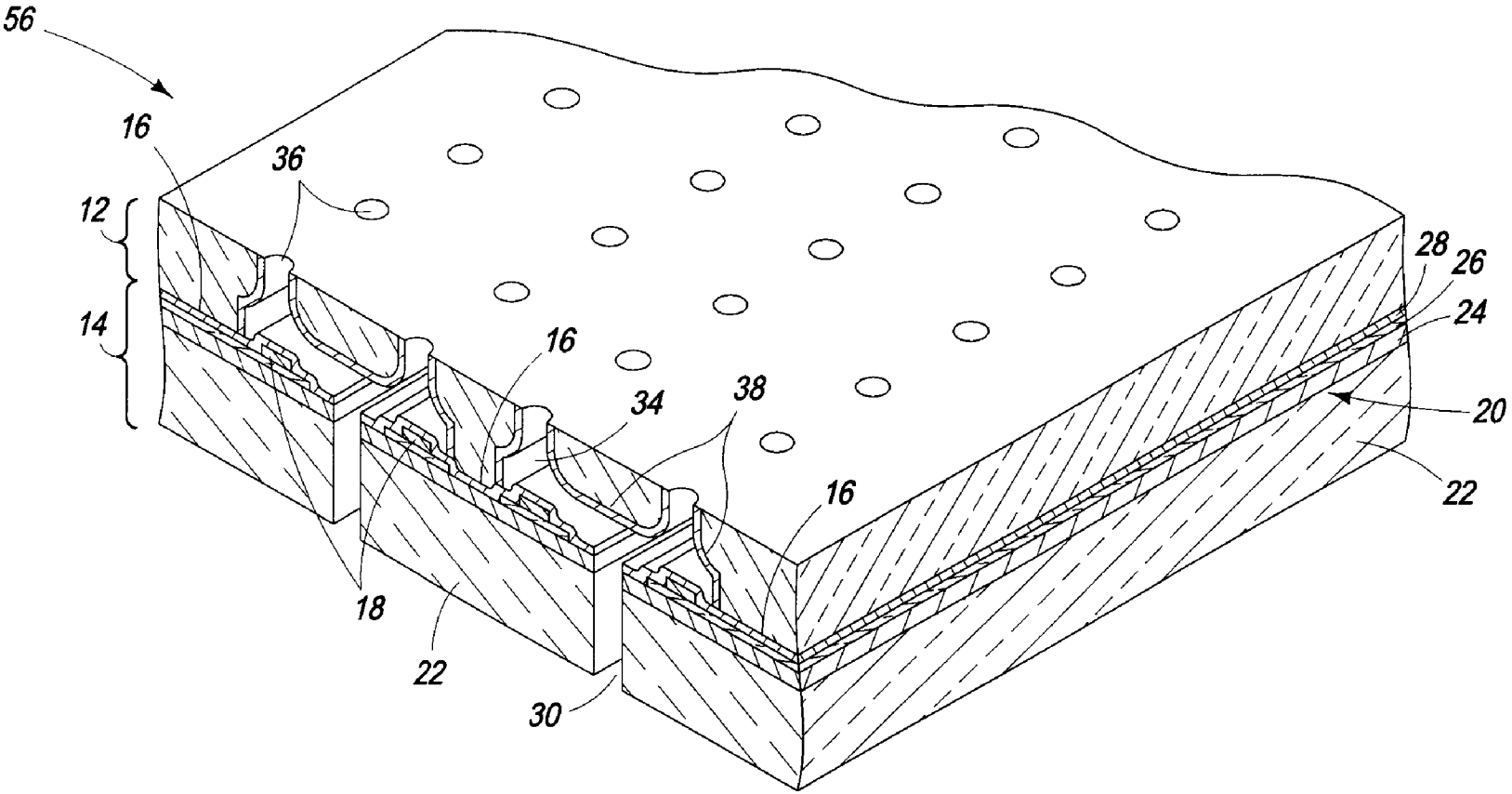

FIGS. 16 and 17 are elevation and perspective section views, respectively, illustrating a thermal inkjet printhead structure 56 according to another embodiment of the disclosure. FIG. 18 is a detail section view of a portion of printhead structure 56 within the circle shown in FIG. 16. Printhead structure 56 is similar to printhead structure 10 shown in FIGS. 1-3—only the configuration of the substrate and ink channels is different. Thus, for convenience, the same part numbers are used to designate the same or similar components in both printhead structure 10 and printhead structure 56.

Referring to FIGS. 16-18, printhead structure 56 is formed as a composite structure that includes an orifice sub-structure 12 and an ejector element sub-structure 14 bonded together along a bonding interface 16. Firing resistors 18 in ejector element sub-structure 14 are formed as part of a thin film stack 20 on a substrate 22. Although a silicon substrate 22 is typical, other suitable substrate materials could be used. In addition to firing resistors 18, thin-film stack 20 usually also will include layers/films that electrically insulate resistors 18 from surrounding structures, provide conductive paths to resistors 18, and help protect against contamination, corrosion and wear (such protection is often referred to passivation). In the embodiment shown, as best seen in FIG. 18, film stack 20 includes a field oxide layer 24 on substrate 22, a glass layer 26 on field oxide 24, and a passivation dielectric layer 28 over resistors 18 and glass layer 26.

Channels 30 in substrate 22 carry ink to ink feed slots 32 that extend through film stack 20 near resistors 18. Ink enters a firing chamber 34 associated with each firing resistor 18 through a corresponding feed slot 32. Ink drops are expelled or "fired" from each chamber 34 through an orifice 36 in orifice sub-structure 12. Orifice sub-structure 12 may include a dielectric or other suitable passivation layer 38 along those areas exposed to ink, for example at firing chambers 34 and orifices 36.

Figure 19:
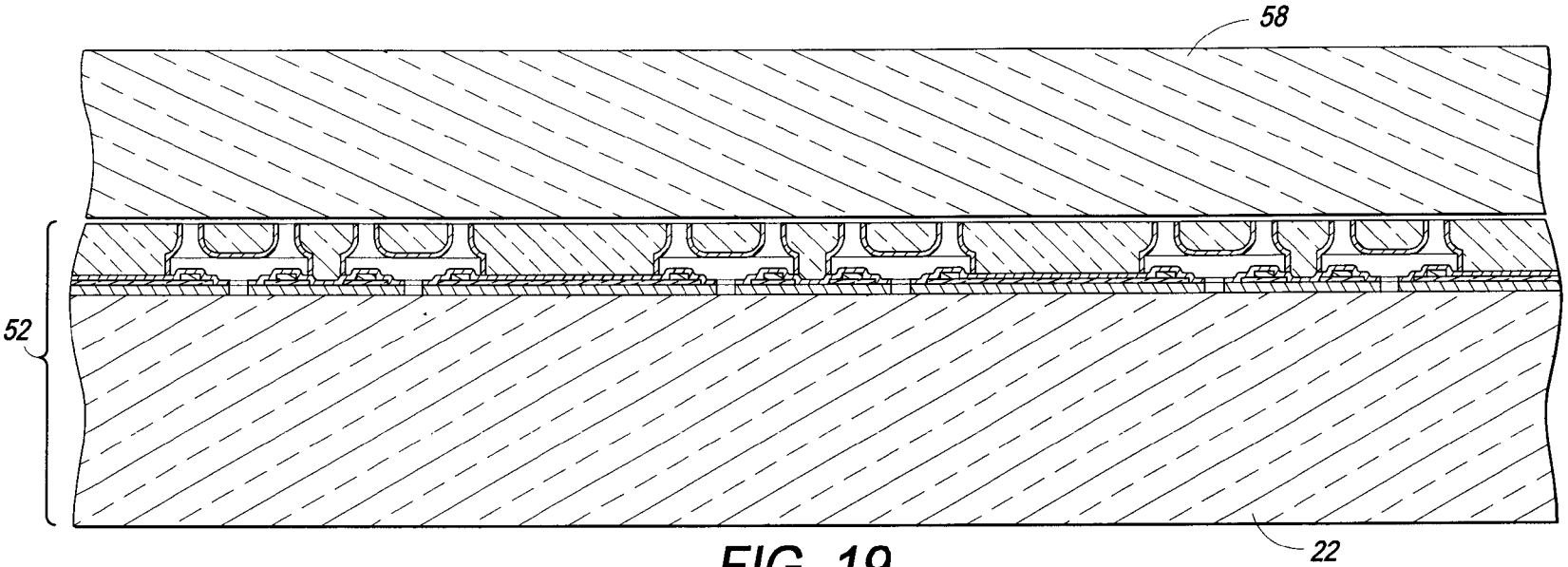
FIGS. 19-27 are elevation section views illustrating one embodiment of a method for fabricating a thermal inkjet printhead structure such as the one shown in FIGS. 16 and 17.

FIGS. 19-27 are elevation section views illustrating one embodiment of a method for fabricating a thermal inkjet printhead structure, such as printhead structure 56 shown in FIGS. 16 and 17. The method illustrated in FIGS. 19-27 may be used with a new direct bond in-process printhead structure, such as structure 52 shown in FIG. 7, or with a conventional in-process printhead structure. Referring first to FIG. 19, in-process printhead structure 52 (with layer 44 removed to open orifices 36) is temporarily attached to a carrier 58 along the exposed outer surface of in-process orifice sub-structure 48. Carrier 58 is used to strengthen the in-process structure for subsequent processing. Hence, a glass wafer or other suitably strong, stable substrate may be used for carrier 58. Carrier 58 is temporarily attached to orifice sub-structure 48 with wax, resist, a double coated adhesive film, or another suitable temporary bonding agent. Some double coated adhesive films, for example, include a permanent bonding pressure sensitive adhesive on one side to attach to carrier 58 and a temporary bond thermal release adhesive on the other side to attach to sub-structure 48.

Figure 20:
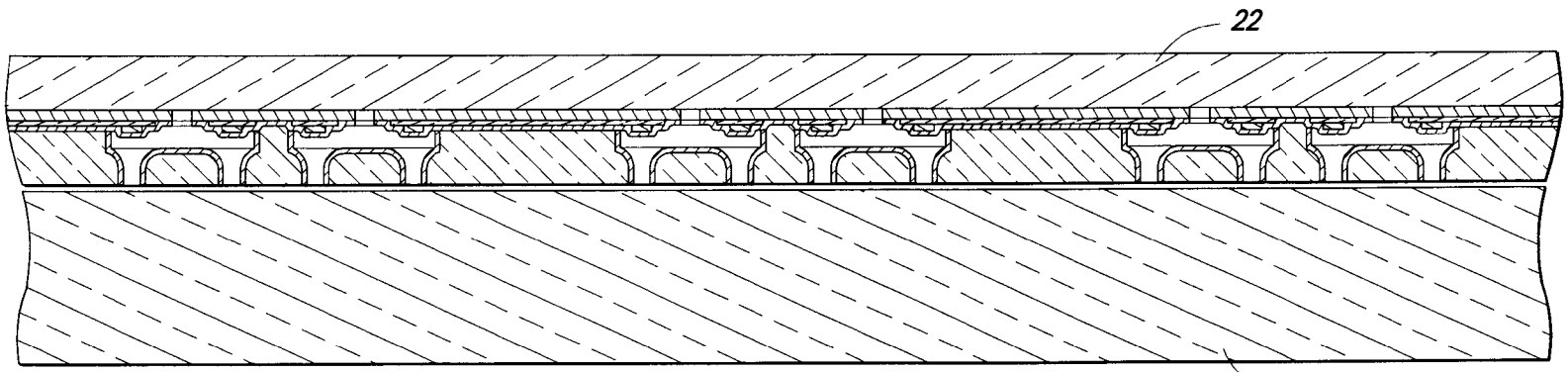
Figure 21:
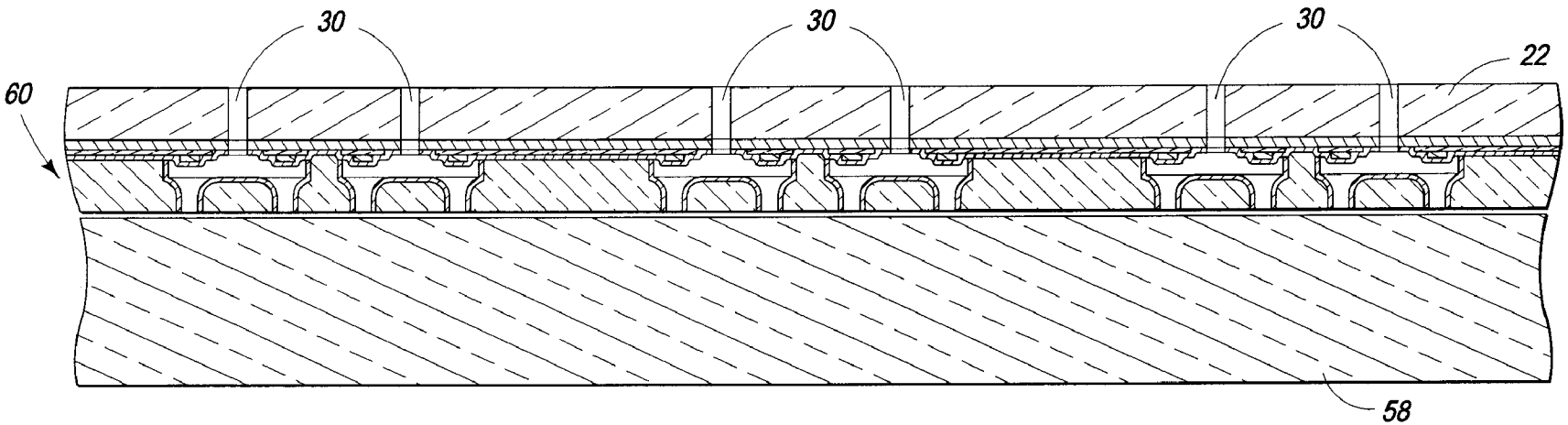
Figure 22:
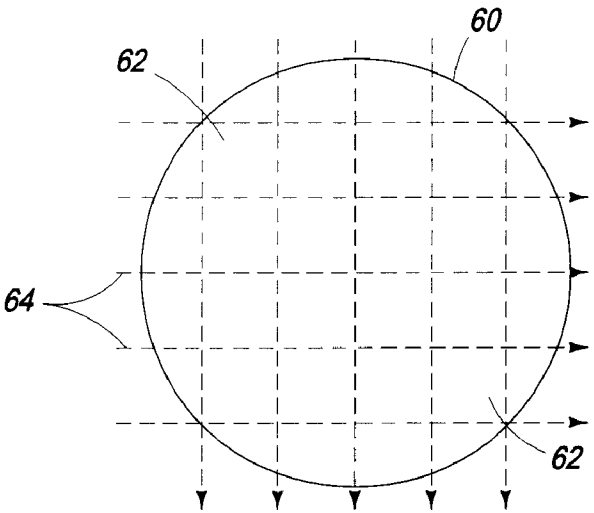
Figure 23:
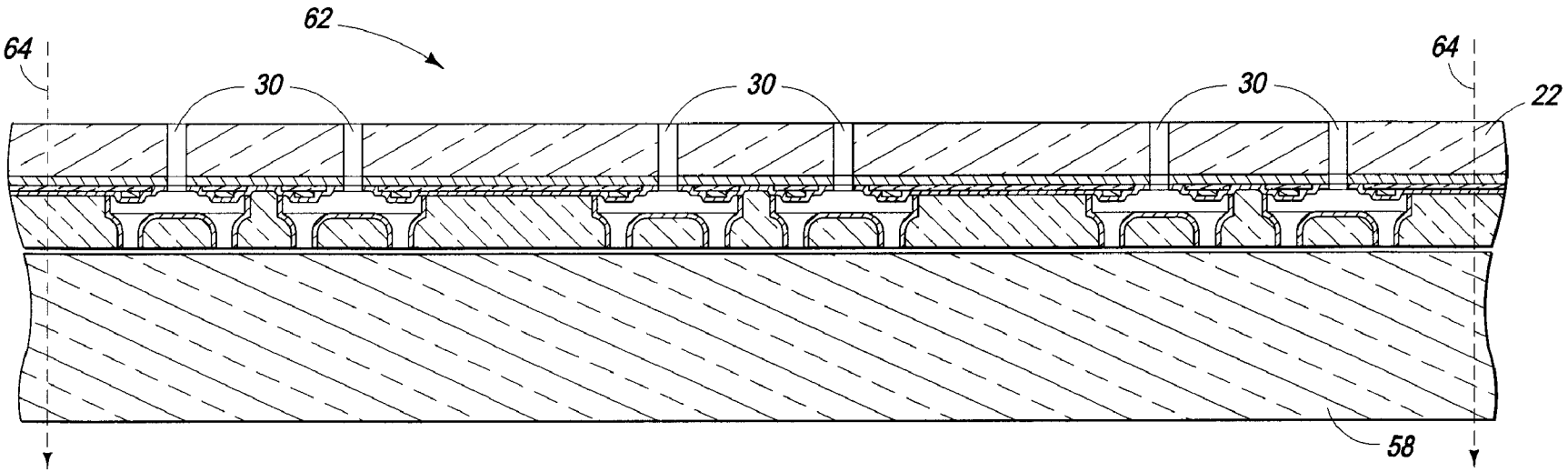

Referring to FIG. 20, ejector substrate 22 is thinned to a desired thickness by, for example, back grinding the silicon substrate 22 until reaching the desired thickness. Referring to FIG. 21, the thinned ejector substrate 22 is patterned and etched to form ink channels 30 with, for example, a laser or dry reactive ion etch. Temporarily attaching in-process printhead 52 to carrier 58 allows thinning substrate 22 to 20-200 μm, compared to a conventional fabrication process in which the ejector substrate is about 720 μm. The thinned substrate 22 simplifies the channel etch—instead of cutting through a 700 μm wafer, the ink channels can be etched through a comparatively thin silicon membrane. The thinned substrate 22 allows forming more narrow channels while still maintaining the desired channel aspect ratio. It is expected that a shorter ink path through channels 30 to firing chambers 34 will increase the frequency response of printhead structure 56 compared to the longer wider channels 30 in a printhead structure such as structure 10 shown in FIGS. 1 and 2. In printhead structure 56, one ink channel feeds ink to one slot 32 for two adjacent firing chambers 34 (along the section shown) instead of one channel feeding two slots for four adjacent firing chambers in printhead structure 10.

Figure 24:
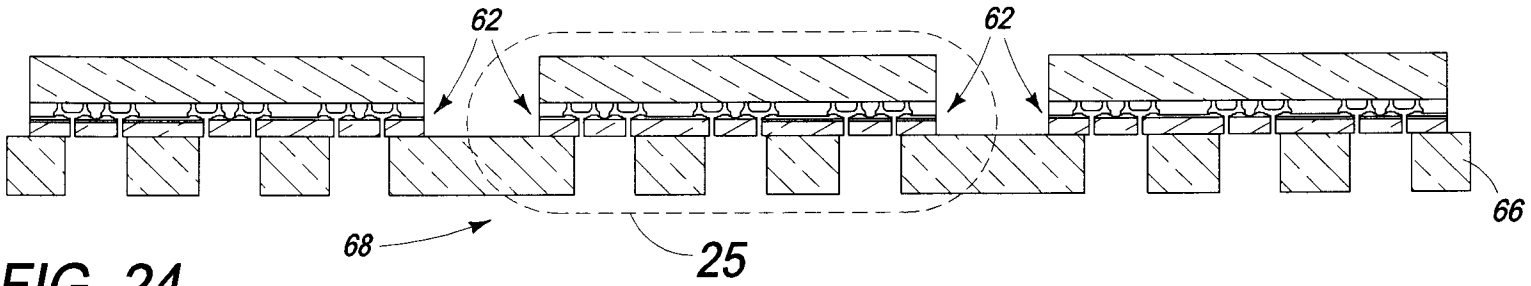
Figure 25:
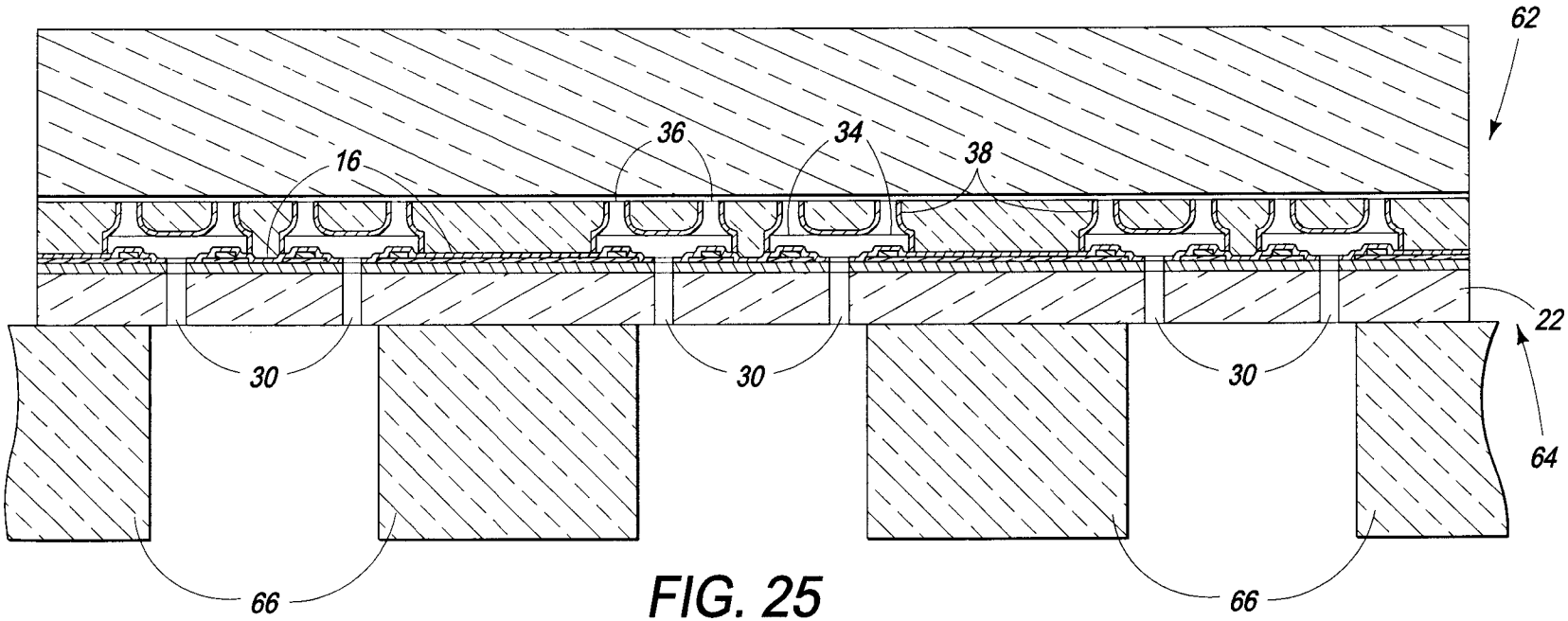

A carrier wafer 58 may be released from an in-process printhead wafer structure 60 at the "wafer level" following the completion of the printhead structure 56 shown in FIG. 21. Alternatively, carrier 58 may be left in place to facilitate further processing. For example, and referring to FIGS. 22 and 23, in-process printhead wafer structure 60 may be sawn or otherwise singulated into individual printhead dies 62 while still attached to carrier 58, as indicated by saw cut lines 64. Processing may continue with dies 62 attached to carrier 58, mounting multiple dies 62 to a glass, ceramic or other suitable substrate 66 to form a multi-die printhead module 68 as shown in FIGS. 24 and 25. Temporary carrier 58 adds strength to the otherwise fragile dies 62 to help minimize the risk of damaging the dies 62 during these processing operations. In addition, the comparatively thick carrier 58 helps flatten the die assembly to make the die attach process easier.

Figure 26:
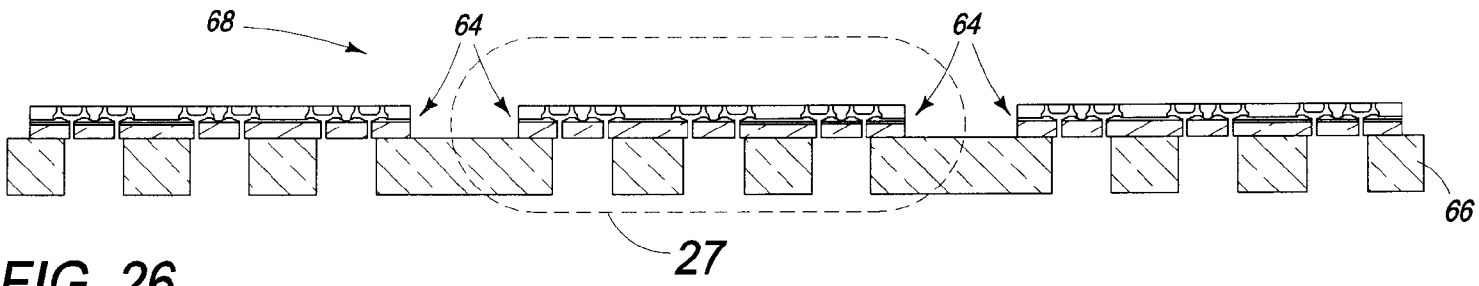
Figure 27:
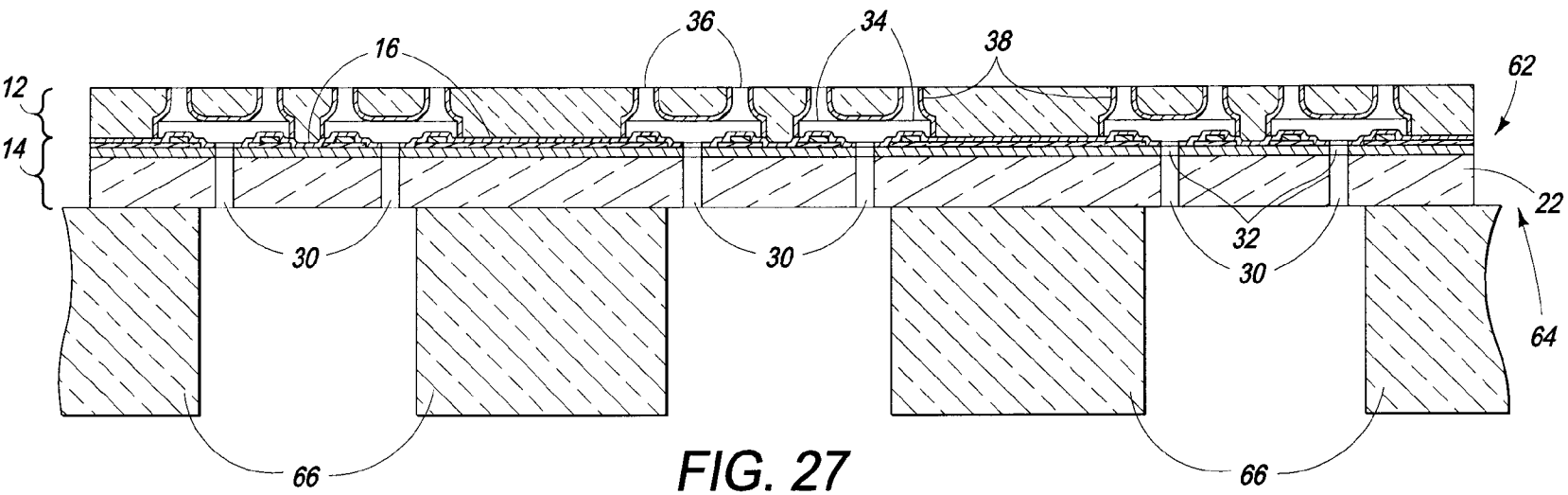

Referring to FIGS. 26 and 27, carrier 58 is then released by subjecting each module 68 to a release mechanism appropriate for the temporary bonding agent used to attach carrier 58. For example, if wax is used as the temporary bonding agent, then carrier 58 may be released by heating. Some temporary bonding agents may require immersing or washing module 68 in a solvent to release carrier 58. Of course, other release mechanisms are possible depending on the characteristics of the temporary bonding agent used to attach carrier 58.

Figure 28:
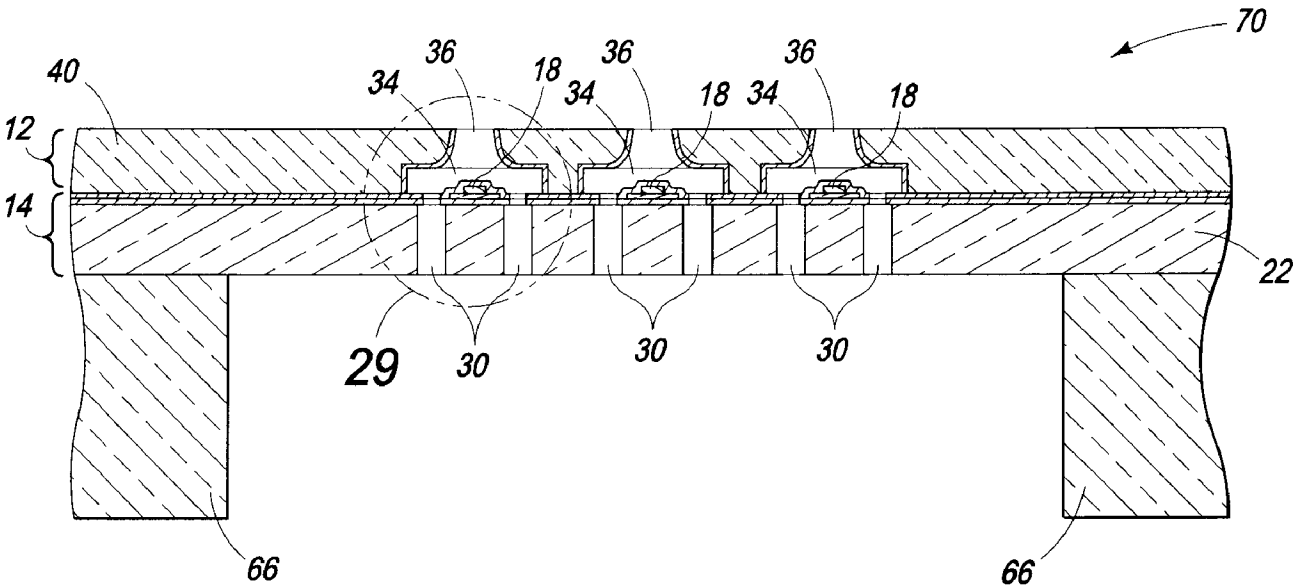
FIG. 28 illustrates another embodiment of a printhead structure that may be fabricated using the method of FIGS. 19-27 in which multiple ink channels carry ink to a single firing chamber.
Figure 29:
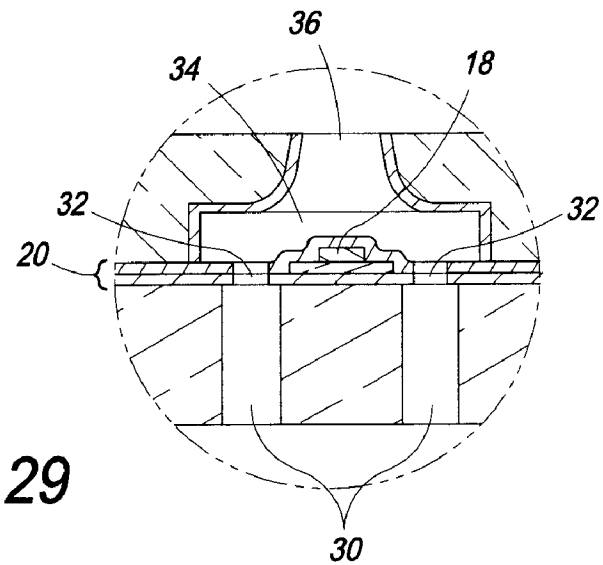
FIG. 29 is a detail section view of a portion of the printhead structure shown in FIG. 28.

FIG. 28 illustrates another embodiment of a printhead structure, designated by part number 70, that may be fabricated using the method of FIGS. 19-27. FIG. 29 is a detail section view of a portion of printhead structure 70. Referring to FIGS. 28 and 29, printhead structure 70 includes multiple ink feed channels 30 that carry ink to a single firing chamber 34. As noted above with reference to FIG. 20, the thinned substrate 22 simplifies the channel etch and allows forming more narrow channels while still maintaining the desired channel aspect ratio. Thus, engineers are afforded greater flexibility in designing printhead structures to achieve robust ink flow with greater frequency response. Thin film stack 20 may extend slightly beyond substrate 22 at each channel 30 such that feed slots 32 are more narrow than channels 30. This configuration offers additional design flexibility to control the ink flow speed through feed slot 32 and reduce the heat generated by resistor 18, while independently controlling the ink blow back to help maintain firing chamber efficiency. In the dual channel configuration shown in FIG. 28, for example, the size of ink channels 30 may be controlled much more precisely over channel structures formed with conventional fabrication methods, to more precisely control ink flow to the firing chambers 34.

As used in this document, forming one part "over" another part does not necessarily mean forming one part above the other part. A first part formed over a second part will mean the first part formed above, below and/or to the side of the second part depending on the orientation of the parts. Also, "over" includes forming a first part on a second part or forming the first part above, below or to the side of the second part with one or more other parts in between the first part and the second part.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector structure, comprising an orifice sub-structure and an ejector element sub-structure direct contact bonded together along a direct contact bonding interface, the orifice sub-structure having a plurality of orifices therein each positioned adjacent to a corresponding one of a plurality of fluid ejection elements on the ejector element sub-structure;

wherein the direct contact bonding interface is formed at the interface between an oxide or silicon direct contact bonding surface on the orifice-sub-structure and an oxide or silicon direct contact bonding surface on the ejector element sub-structure.

2. The structure of claim 1, wherein the direct contact bonding interface is formed at the interface between a silicon direct contact bonding surface on the orifice-sub-structure and an oxide direct contact bonding surface on the ejector element sub-structure.

3. The structure of claim 1, wherein the ejector element sub-structure includes:

a substrate;

a thin film stack over the substrate, the ejector elements formed in the film stack and the film stack having a plurality of openings therein to a plurality of fluid ejection chambers each associated with a corresponding ejector element such that fluid may be ejected from a fluid ejection chamber through an orifice in the orifice sub-structure; and the substrate having a plurality of channels therein through which fluid may pass to the openings in the film stack.

4. The structure of claim 3, wherein the substrate has a thickness not greater than 200 μm.

5. The structure of claim 4, wherein the film stack has at least two openings therein to each fluid ejection chamber and the substrate has a channel to each of the openings in the film stack.

6. The structure of claim 5, wherein each opening in the film stack is more narrow than the corresponding channel in the substrate.

7. The structure of claim 1 comprising an inkjet printhead wherein the fluid ejection elements on the ejector element sub-structure each comprises an ink ejection element.

* * * * *